US012398604B2

(12) United States Patent
Katanguri

(10) Patent No.: US 12,398,604 B2
(45) Date of Patent: Aug. 26, 2025

(54) AUTOMATICALLY SWITCHING BETWEEN MANAGED PRESSURE DRILLING AND WELL CONTROL OPERATIONS

(71) Applicant: Schlumberger Technology Corporation, Sugar Land, TX (US)

(72) Inventor: Suman Katanguri, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/685,310

(22) PCT Filed: Aug. 18, 2022

(86) PCT No.: PCT/US2022/040774

§ 371 (c)(1),
(2) Date: Feb. 21, 2024

(87) PCT Pub. No.: WO2023/027944

PCT Pub. Date: Mar. 2, 2023

(65) Prior Publication Data

US 2024/0426182 A1 Dec. 26, 2024

Related U.S. Application Data

(60) Provisional application No. 63/235,995, filed on Aug. 23, 2021.

(51) Int. Cl.
*E21B 21/08* (2006.01)
*E21B 43/12* (2006.01)
(Continued)

(52) U.S. Cl.
CPC ..... *E21B 21/08* (2013.01); *E21B 43/12* (2013.01); *E21B 47/06* (2013.01); *E21B 47/10* (2013.01)

(58) Field of Classification Search
CPC ..... E21B 21/08; E21B 43/12; E21B 47/06; E21B 47/10
(Continued)

(56) References Cited

U.S. PATENT DOCUMENTS 10,648,315 B2 5/2020 Couturier
11,047,182 B2 6/2021 Parthasarathy
(Continued)

*Primary Examiner* — Taras P Bemko
(74) *Attorney, Agent, or Firm* — Jeffrey D. Frantz

(57) ABSTRACT

A control system for controlling pressure of fluid within a wellbore includes a rotating control device (RCD), a distribution manifold, a choke and kill (CK) manifold, and a managed pressure drilling (MPD) manifold fluidly connected with each other, a sensor operable to facilitate fluid measurements indicative of a property of the fluid, and a controller communicatively connected with the distribution manifold and the sensor. The controller is operable to receive the fluid measurements, cause the distribution manifold to direct the fluid discharged out of the wellbore via the RCD to flow through the MPD manifold to thereby permit the MPD manifold to control the pressure of the fluid within the wellbore, and cause the distribution manifold to direct the fluid discharged out of the wellbore via the RCD to flow through the CK manifold to thereby permit the CK manifold to control the pressure of the fluid within the wellbore.

20 Claims, 4 Drawing Sheets

(51) Int. Cl.
*E21B 47/06* (2012.01)
*E21B 47/10* (2012.01)

(58) Field of Classification Search
USPC ..... 166/250.07
See application file for complete search history.

(56) References Cited

U.S. PATENT DOCUMENTS

| | | | | |
|---|---|---|---|---|
| 11,536,103 | B2 | 12/2022 | Parthasarathy | |
| 2005/0092523 | A1 | 5/2005 | McCaskill | |
| 2012/0267118 | A1 | 10/2012 | Orbell | |
| 2018/0010405 | A1* | 1/2018 | Angstmann | E21B 33/0355 |
| 2019/0145202 | A1 | 5/2019 | Vavik | |
| 2020/0190939 | A1 | 6/2020 | Gray | |
| 2020/0270953 | A1 | 8/2020 | Ziegler | |
| 2021/0010365 | A1 | 1/2021 | Botnan | |

* cited by examiner

AUTOMATICALLY SWITCHING BETWEEN MANAGED PRESSURE DRILLING AND WELL CONTROL OPERATIONS

CROSS-REFERENCE TO RELATED APPLICATION

This application claims priority to International Application No. PCT/US2022/040774, entitled "AUTOMATICALLY SWITCHING BETWEEN MANAGED PRESSURE DRILLING AND WELL CONTROL OPERATIONS," filed Aug. 18, 2022, which claims priority to and the benefit of U.S. Provisional Patent Application No. 63/235,995, entitled "AUTOMATICALLY SWITCHING BETWEEN MANAGED PRESSURE DRILLING AND WELL CONTROL OPERATIONS," filed Aug. 23, 2021, the disclosures of which are hereby incorporated herein by reference in their entirety.

BACKGROUND OF THE DISCLOSURE

Wells extend into the ground or ocean bed to facilitate recovery of natural deposits of oil, gas, and other materials that are trapped in subterranean formations. Well construction (e.g., drilling) operations may be performed at a wellsite by a well construction system (e.g., a drilling rig) having various surface and subterranean well construction equipment operating in a coordinated manner. For example, a drive mechanism, such as a top drive located at a wellsite surface, can be utilized to rotate and advance a drill string into a subterranean formation to drill a wellbore. The drill string may include a plurality of drill pipes coupled together and terminating with a drill bit. Length of the drill string may be increased by adding additional drill pipes while the depth of the wellbore increases. Drilling fluid may be pumped from the wellsite surface down through the drill string to the drill bit. The drilling fluid lubricates and cools the drill bit and carries formation cuttings from the wellbore back to the wellsite surface. The drilling fluid returning to the surface is then cleaned and again pumped through the drill string.

Managed pressure drilling (MPD) is an adaptive drilling operation used to control pressure within an annular region of a wellbore ("wellbore annulus") defined between an outer surface of the drill string and a sidewall of the wellbore. During MPD, the upper end of the wellbore annulus is closed from the atmosphere using a rotating control device (RCD), which includes an annular sealing element that engages the outer surface of the drill string to prevent the flow of drilling fluid past the RCD and to the atmosphere. The sealing element is rotatable with the drill string to seal the wellbore annulus while permitting rotation of the drill string. An MPD manifold is fluidly connected with the RCD and operable to control the flow rate at which the drilling fluid is discharged from the wellbore annulus. The flow rate of the drilling fluid through the MPD manifold is restricted to generate back pressure at the upper end of the wellbore annulus. The flow rate through the MPD manifold can be adjusted to control the back pressure and, thus, control wellbore pressure at the bottom and intermediate locations of the wellbore annulus.

Pressure within the wellbore annulus ("annular pressure") may be constrained by various properties of the subterranean formation through which the wellbore extends. For example, the annular pressure may be kept above a pore pressure of the subterranean formation but below a fracture initiation pressure of the subterranean formation (e.g., to prevent the initiation of fractures within the formation). The flow rate through the MPD manifold can be adjusted to compensate for pressure variations within the wellbore annulus to maintain the wellbore annulus at an intended pressure. However, when the annular pressure falls below the formation pore pressure, formation fluid (or reservoir fluid) can flow into the wellbore and mix with the drilling fluid. Such unintended influx of formation fluid (e.g., oil, water, and/or gas) into the wellbore is known in the oil and gas industry as a kick.

An MPD manifold is ill-equipped to maintain an intended annular pressure when formation gas flows into the wellbore, resulting in disruption of MPD operations. For example, when a volume (i.e., a pocket) of formation gas reaches the MPD manifold, the MPD manifold permits the gas to escape too quickly, resulting in sudden decrease of backpressure, causing a decrease of annular pressure and inflow of additional formation fluid. Flow of formation gas through the MPD manifold can damage the MPD manifold. For example, when a volume of formation gas reaches the MPD manifold, the formation gas can cause a choke of the MPD manifold to oscillate (i.e., open and close) at a high frequency and/or amplitude, and thereby damage the choke.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
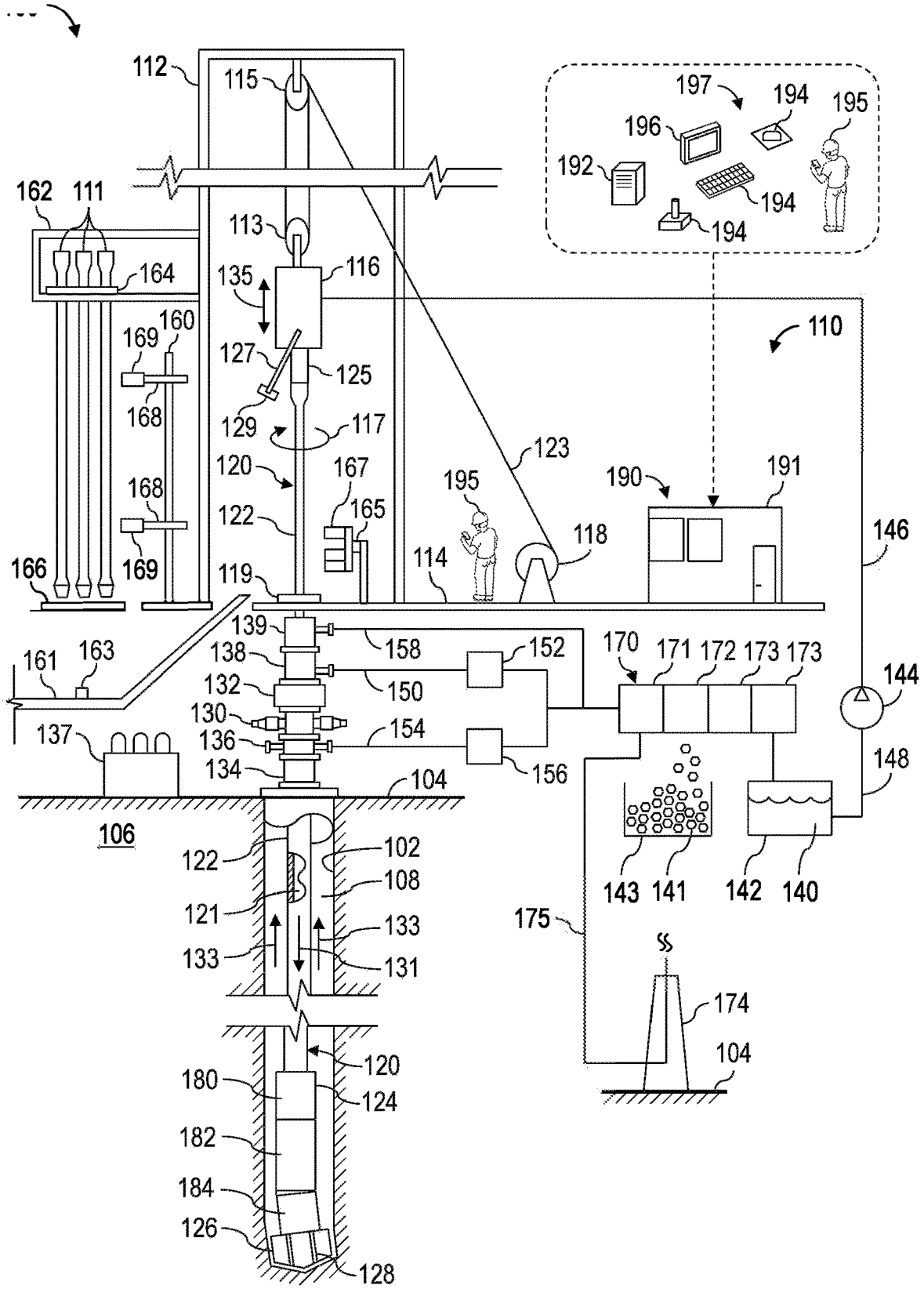
FIG. 1 is a schematic view of at least a portion of an example implementation of apparatus according to one or more aspects of the present disclosure.

It is to be understood that the following disclosure describes many example implementations for different aspects introduced herein. Specific examples of components and arrangements are described below to simplify the present disclosure. These are merely examples, and are not intended to be limiting. In addition, the present disclosure may repeat reference numerals and/or letters in the various examples. This repetition is for simplicity and clarity, and does not in itself dictate a relationship between the various implementations described herein. Moreover, the coupling or connection of a first feature with a second feature in the description that follows may include implementations in which the first and second features are formed in direct contact, and may also include implementations in which additional features may interpose the first and second features, such that the first and second features may not be in direct contact.

Systems and methods (e.g., processes, operations, etc.) according to one or more aspects of the present disclosure may be utilized or otherwise implemented in association with an automated well construction system (i.e., well construction rig) at an oil and gas wellsite, such as for constructing a well (including drilling a wellbore) for extracting hydrocarbons (e.g., oil and/or gas) from a subterranean formation. FIG. 1 is a schematic view of at least a portion of an example implementation of a well construction system 100 according to one or more aspects of the present disclosure. The well construction system 100 represents an example environment in which one or more aspects of the present disclosure described below may be implemented. The well construction system 100 may be or comprise a well construction (e.g., drilling) rig and associated well construction equipment. Although the well construction system 100 is depicted as an onshore implementation, the aspects described below are also applicable or readily adaptable to offshore implementations.

The well construction system 100 is depicted in relation to a wellbore 102 formed by rotary and/or directional drilling from a wellsite surface 104 and extending into a subterranean formation 106. The well construction system 100 comprises or is associated with various well construction equipment (i.e., wellsite equipment), including surface equipment 110 located at the wellsite surface 104 and a drill string 120 suspended within the wellbore 102. The surface equipment 110 may include a mast, a derrick, and/or other support structure 112 disposed over a rig floor 114. The drill string 120 may be suspended within the wellbore 102 from the support structure 112. The support structure 112 and the rig floor 114 are collectively supported over the wellbore 102 by legs and/or other support structures (not shown).

The drill string 120 may comprise a bottom-hole assembly (BHA) 124 and means 122 for conveying the BHA 124 within the wellbore 102. The conveyance means 122 may comprise a plurality of interconnected tubulars, such as drill pipe, heavy-weight drill pipe (HWDP), wired drill pipe (WDP), tough logging condition (TLC) pipe, and drill collars, among other examples. The conveyance means 122 may instead comprise coiled tubing for conveying the BHA 124 within the wellbore 102. A downhole end of the BHA 124 may include or be coupled to a drill bit 126. Rotation of the drill bit 126 and the weight of the drill string 120 collectively operate to form the wellbore 102. The drill bit 126 may be rotated from the wellsite surface 104 and/or via a downhole mud motor 184 connected with the drill bit 126. The BHA 124 may also include various downhole devices and/or tools 180, 182.

The support structure 112 may support a driver, such as a top drive 116, operable to connect with an upper end of the drill string 120, and to impart rotary motion 117 and vertical motion 135 to the drill string 120, including the drill bit 126. However, other drivers, such as a kelly and rotary table (neither shown), may be utilized instead of or in addition to the top drive 116 to impart the rotary motion 117 to the drill string 120. The top drive 116 and the connected drill string 120 may be suspended from the support structure 112 via hoisting equipment, which may include a traveling block 113, a crown block 115, and a drawworks 118 storing a support cable or line 123. The crown block 115 may be connected to or otherwise supported by the support structure 112, and the traveling block 113 may be coupled with the top drive 116. The drawworks 118 may be mounted on or otherwise supported by the rig floor 114. The crown block 115 and traveling block 113 comprise pulleys or sheaves around which the support line 123 is reeved to operatively connect the crown block 115, the traveling block 113, and the drawworks 118 (and perhaps an anchor). The drawworks 118 may thus selectively impart tension to the support line 123 to lift and lower the top drive 116, resulting in the vertical motion 135. The drawworks 118 may comprise a drum, a base, and an actuator (e.g., an electric motor) (not shown) operable to drive the drum to rotate and reel in the support line 123, causing the traveling block 113 and the top drive 116 to move upward. Similarly, the drawworks 118 is operable to reel out the support line 123 via controlled rotation of the drum, causing the traveling block 113 and the top drive 116 to move downward.

The top drive 116 may comprise a grabber, a swivel (neither shown), elevator links 127 terminating with an elevator 129, and a drive shaft 125 operatively connected with a rotary actuator (e.g., an electric motor) (not shown), such as via a gear box or transmission (not shown). The drive shaft 125 may be selectively coupled with the upper end of the drill string 120 and the rotary actuator may be selectively operated to rotate the drive shaft 125 and the drill string 120 coupled with the drive shaft 125. Thus, during drilling operations, the top drive 116, in conjunction with operation of the drawworks 118, may advance the drill string 120 into the formation 106 to form the wellbore 102. The elevator links 127 and the elevator 129 of the top drive 116 may handle tubulars (e.g., singles or stands of drill pipes, drill collars, casing joints, etc.) that are not mechanically coupled to the drive shaft 125.

The drill string 120 may be conveyed within the wellbore 102 through various fluid control devices disposed at the wellsite surface 104 over an opening of the wellbore 102 and perhaps below the rig floor 114. The fluid control devices may be operable to control fluid within the wellbore 102. The fluid control devices may include a blowout preventer (BOP) stack 130 for maintaining well pressure control and comprising a series of pressure barriers (e.g., rams) between the wellbore 102 and an annular preventer 132. The fluid control devices may also include an RCD 138 mounted above the annular preventer 132. The fluid control devices 130, 132, 138 may be mounted on top of a wellhead 134.

A power unit 137 (i.e., a BOP control or closing unit) may be operatively connected with one or more of the fluid control devices 130, 132, 138 and operable to actuate, drive, operate, or otherwise control one or more of the fluid control devices 130, 132, 138. The power unit 137 may be or comprise a hydraulic fluid power unit fluidly connected with the fluid control devices 130, 132, 138 and selectively operable to hydraulically drive (e.g., open, close, etc.) various portions (e.g., rams, valves, seals) of the fluid control devices 130, 132, 138. The power unit 137 may comprise one or more hydraulic pumps actuated by electric motors and operable to pressurize hydraulic fluid stored in hydraulic accumulators for operating the fluid control devices 130, 132, 138.

The well construction system 100 may further include drilling fluid circulation equipment operable to circulate fluids between the surface equipment 110 and the drill bit 126 during drilling and other operations. For example, the drilling fluid circulation equipment may be operable to inject a drilling fluid from the wellsite surface 104 into the wellbore 102 via an internal fluid passage 121 extending longitudinally through the drill string 120. The drilling fluid circulation equipment may comprise a pit, a tank, and/or other fluid container 142 holding the drilling fluid 140 (i.e., drilling mud), and one or more mud pump units 144 (i.e., drilling fluid pumps) operable to move the drilling fluid 140 from the container 142 into the fluid passage 121 of the drill string 120 via a fluid conduit 146 extending from the pump units 144 to the top drive 116 and an internal passage extending through the top drive 116. Each pump unit 144 may comprise a fluid pump (not shown) operable to pump the drilling fluid 140 and a rotary actuator (e.g., an electric motor) (not shown) operable to drive the corresponding fluid pump. The fluid conduit 146 may comprise one or more of a pump discharge line, a stand pipe, a rotary hose, and a gooseneck connected with a fluid inlet of the top drive 116. The pumps 144 and the container 142 may be fluidly connected by a fluid conduit 148, such as a suction line.

During drilling operations, the drilling fluid may continue to flow downhole through the internal passage 121 of the drill string 120, as indicated by directional arrow 131. The drilling fluid may exit the BHA 124 via ports 128 in the drill bit 126 and then circulate uphole through a wellbore annulus 108 of the wellbore 102 defined between an outer surface of the drill string 120 and a sidewall of the wellbore 102, such flow being indicated by directional arrows 133. In this manner, the drilling fluid lubricates the drill bit 126 and carries formation cuttings uphole to the wellsite surface 104. The returning drilling fluid may exit the wellbore annulus 108 via different fluid control devices during different stages or scenarios of well drilling operations. For example, the drilling fluid may exit the wellbore annulus 108 via a bell nipple 139, the RCD 138, or a ported adapter 136 (e.g., a spool, cross adapter, a wing valve, etc.) located below one or more rams of the BOP stack 130.

During normal (e.g., overbalanced) drilling operations, the drilling fluid may exit the wellbore annulus 108 via the bell nipple 139 and then be directed toward drilling fluid reconditioning equipment 170 via a fluid conduit 158 (e.g., gravity return line) to be cleaned and/or reconditioned, as described below, before being returned to the container 142 for recirculation. During MPD operations, the drilling fluid may exit the wellbore annulus 108 via the RCD 138 and then be directed into an MPD manifold 152 via a fluid conduit 150 (e.g., a drilling pressure control line). The MPD manifold 152 may include at least one choke and a plurality of fluid valves (see FIG. 3) collectively operable to control the flow of the drilling fluid (and perhaps formation fluid) through and out of the MPD manifold 152. The MPD manifold 152 may generate backpressure that is applied to the upper (i.e., uphole) end of the wellbore annulus 108 to control pressure within the entire wellbore annulus 108 of the wellbore 102 by variably restricting the flow rate of the drilling fluid through the MPD manifold 152 as part of MPD operations. The greater the restriction to flow through the MPD manifold 152, the greater the backpressure applied to the upper end of the wellbore annulus 108 and the greater the pressure along the entire wellbore annulus 108. The drilling fluid exiting the MPD manifold 152 may then pass through the drilling fluid reconditioning equipment 170 before being returned to the container 142 for recirculation.

During well pressure control operations, such as when one or more rams of the BOP stack 130 is closed, the drilling fluid may exit the wellbore annulus 108 via the ported adapter 136 and be directed into a choke and kill (CK) manifold 156 (or a rig choke manifold) via a fluid conduit 154 (e.g., a rig choke line). The CK manifold 156 may include at least one choke and a plurality of fluid valves (see FIG. 3) collectively operable to control the flow of the drilling fluid (and perhaps formation fluid) through and out of the CK manifold 156. The CK manifold 156 may variably restrict the flow rate of the drilling fluid through the CK manifold 156 as part of well pressure control operations to thereby facilitate pressure control of the drilling fluid within the wellbore 102. The drilling fluid exiting the CK manifold 156 may then pass through the drilling fluid reconditioning equipment 170 before being returned to the container 142 for recirculation.

Before being returned to the container 142, the drilling fluid returning to the wellsite surface 104 may be cleaned and/or reconditioned via the drilling fluid reconditioning equipment 170, which may include one or more of liquid-gas (i.e., mud gas) separators 171, shale shakers 172, and other drilling fluid cleaning and reconditioning equipment 173. The cleaned and reconditioned drilling fluid may be transferred to the fluid container 142, the solid particles 141 removed from the drilling fluid may be transferred to a solids container 143 (e.g., a reserve pit), and/or the removed gas may be transferred to a flare stack 174 via a conduit 175 (e.g., a flare line) to be burned or to a container (not shown) for storage and removal from the wellsite.

The surface equipment 110 may include tubular handling equipment operable to store, move, connect, and disconnect tubulars (e.g., drill pipes) to assemble and disassemble the conveyance means 122 of the drill string 120 during drilling operations. For example, a catwalk 161 may be utilized to convey tubulars from a ground level (e.g., along the wellsite surface 104) to the rig floor 114, thereby permitting the elevator 129 to grab and lift the tubulars above the wellbore 102 for connection with previously deployed tubulars. The catwalk 161 may have a horizontal portion and an inclined portion that extends between the horizontal portion and the rig floor 114. The catwalk 161 may comprise a skate 163 movable along a groove (not shown) extending longitudinally along the horizontal and inclined portions of the catwalk 161. The skate 163 may be operable to convey (e.g., push) the tubulars along the catwalk 161 to the rig floor 114. The tubular handling equipment may further include a tubular handling manipulator (THM) 160 disposed in association with a vertical pipe rack 162 for storing tubulars 111 (e.g., drill pipes, drill collars, drill pipe stands, casing joints, etc.). The vertical pipe rack 162 may comprise or support a fingerboard 164 defining a plurality of slots configured to support or otherwise hold the tubulars 111 within or above a setback 166 (e.g., a platform) located adjacent to, along, or below the rig floor 114. The THM 160 may be operable to transfer the tubulars 111 between the fingerboard 164/setback 166 and the drill string 120 (i.e., space above the suspended drill string 120). For example, the THM 160 may include arms 168 terminating with clamps 169, such as may be operable to grasp and/or clamp onto one of the tubulars 111. The arms 168 of the THM 160 may extend and retract, and/or at least a portion of the THM 160 may be rotatable and/or movable toward and away from the drill string 120, such as may permit the THM 160 to transfer the tubular 111 between the fingerboard 164/setback 166 and the drill string 120.

Power tongs 165 (e.g., an iron roughneck) may be positioned on the rig floor 114. The power tongs 165 may comprise a torqueing portion 167, such as may include a spinner and a torque wrench comprising a lower tong and an upper tong. The torqueing portion 167 of the power tongs 165 may be moveable toward and at least partially around the drill string 120, such as may permit the power tongs 165 to make up and break out connections of the drill string 120.

A set of slips 119 may be located on the rig floor 114, such as may accommodate therethrough the drill string 120 during tubular make up and break out operations and during drilling operations. The slips 119 may be in an open position during drilling operations to permit advancement of the drill string 120, and in a closed position to clamp the upper end (e.g., the uppermost tubular) of the drill string 120 to thereby suspend and prevent advancement of the drill string 120 within the wellbore 102, such as during the make up and break out operations.

During drilling operations, the various well construction equipment of the well construction system 100 may progress through a plurality of coordinated operations (i.e., operational sequences) to drill or otherwise construct the wellbore 102. The operational sequences may change based on a well construction plan, status of the well, status of the subterranean formation, stage of drilling operations (e.g., tripping, drilling, tubular handling, etc.), and type of downhole tubulars (e.g., drill pipe) utilized, among other examples.

The surface equipment 110 of the well construction system 100 may also comprise a control center 190 from which various portions of the well construction system 100, such as the top drive 116, the hoisting equipment 113, 118, 123, the tubular handling equipment 160, 161, 165, the drilling fluid circulation equipment 142, 144, the drilling fluid reconditioning equipment 170, the well control equipment 130, 132, 138, and the BHA 124, among other examples, may be monitored and controlled. The control center 190 may be located on the rig floor 114 or other location of the well construction system 100. The control center 190 may comprise a facility 191 (e.g., a room, a cabin, a trailer, etc.) containing a control workstation 197, which may be operated by rig personnel 195 (e.g., a driller or other human rig operator) to monitor and control various well construction equipment or portions of the well construction system 100. The control workstation 197 may be communicatively connected with a central controller 192 (e.g., a processing device, a computer, etc.), such as may be operable to receive, process, and output information to monitor operations of and provide control to one or more portions of the well construction system 100. For example, the central controller 192 may be communicatively connected with the various surface and downhole equipment described herein, and may be operable to receive signals from and transmit signals to such equipment to perform various operations described herein. The central controller 192 may store executable computer program code, instructions, and/or operational parameters or setpoints, including for implementing one or more aspects of methods and operations described herein. The central controller 192 may be located within and/or outside of the facility 191. Although it is possible that the entirety of the central controller 192 is implemented within one device, it is also contemplated that one or more components or functions of the central controller 192 may be implemented across multiple devices, some or an entirety of which may be implemented as part of the control center 190 and/or located within the facility 191.

The control workstation 197 may be operable for entering or otherwise communicating control data (e.g., commands, signals, information, etc.) to the central controller 192 and other equipment controllers by the rig personnel 195, and for displaying or otherwise communicating information from the central controller 192 and other equipment controllers to the rig personnel 195. The control workstation 197 may comprise a plurality of human-machine interface (HMI) devices, including one or more input devices 194 (e.g., a keyboard, a mouse, a joystick, a touchscreen, etc.) and one or more output devices 196 (e.g., a video monitor, a touchscreen, a printer, audio speakers, etc.). Communication between the central controller 192, the input and output devices 194, 196, and the various well construction equipment may be via wired and/or wireless communication means. However, for clarity and ease of understanding, such communication means are not depicted, and a person having ordinary skill in the art will appreciate that such communication means are within the scope of the present disclosure.

Well construction systems within the scope of the present disclosure may include more or fewer components than as described above and depicted in FIG. 1. Additionally, various equipment and/or subsystems of the well construction system 100 shown in FIG. 1 may include more or fewer components than as described above and depicted in FIG. 1. For example, various engines, electric motors, hydraulics, actuators, valves, and/or other components not explicitly described herein may be included in the well construction system 100, and are within the scope of the present disclosure.

Figure 2:
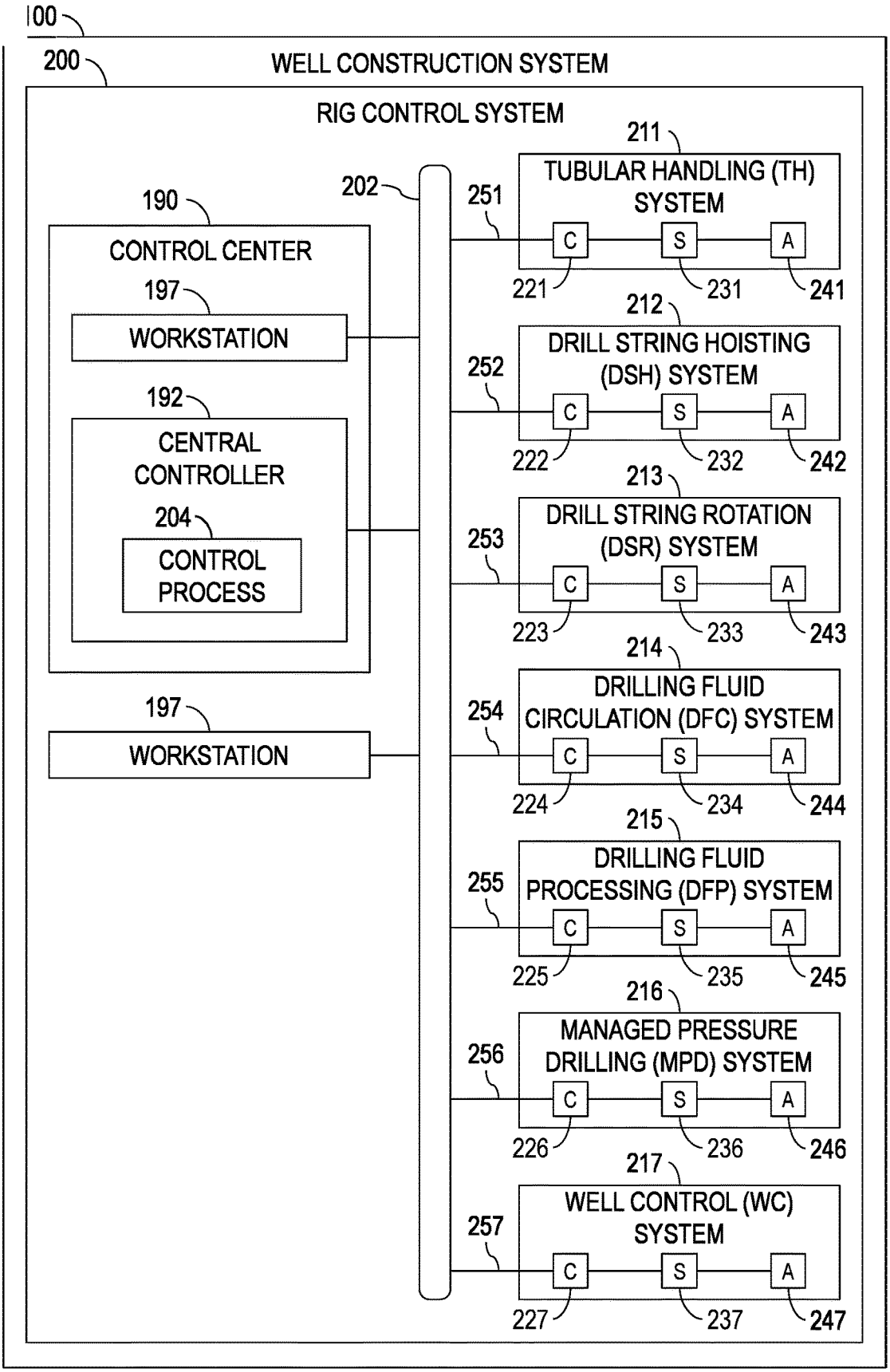
FIG. 2 is a schematic view of at least a portion of an example implementation of apparatus according to one or more aspects of the present disclosure.

The present disclosure further provides various implementations of systems and/or methods for controlling one or more portions of the well construction system 100. FIG. 2 is a schematic view of at least a portion of an example implementation of a drilling rig control system 200 (hereinafter "rig control system") for monitoring and controlling various well construction equipment of the well construction system 100 shown in FIG. 1. The rig control system 200 may comprise one or more features of the well construction system 100, including where indicated by the same reference numerals. Accordingly, the following description refers to FIGS. 1 and 2, collectively.

The rig control system 200 may be in real-time communication with and utilized to monitor and/or control various equipment of the well construction system 100 described herein. The equipment of the well construction system 100 may be grouped into several subsystems, each operable to perform a corresponding operation and/or a portion of the well construction operations described herein. The subsystems may include a tubular handling (TH) system 211, a drill string hoisting system (DSH) system 212, a drill string rotation system (DSR) system 213, a drilling fluid circulation (DFC) system 214, a drilling fluid processing (DFP) system 215, an MPD system 216, and a well control (WC) system 217.

The TH system 211 may comprise, for example, the support structure 112, the pipe rack 162, the THM 160, the catwalk 161, the slips 119, the power tongs 165, and/or other tubular handling equipment. The TH system 211 may perform tubular handling operations and serve as a support platform for tubular rotation equipment and a staging ground for rig operations, such as connection make up and break out operations.

The DSH system 212 may comprise, for example, the blocks 113, 115, the line 123, and the drawworks 118 for collectively hoisting the top drive 116 and the drill string 120 connected to the top drive 116. The DSH system 212 may perform drill string hoisting operations.

The DSR system 213 may comprise, for example, the top drive 116 and/or the rotary table and kelly. The DSR system 213 may perform drill string rotation operations.

The DFC system 214 may comprise, for example, the mud pumps 144, the bell nipple 139, the fluid container 142, the fluid conduits 146, 158, and other drilling fluid circulation equipment. The DFC system 214 may be operable to pump and circulate the drilling fluid downhole through the drill string 120 and uphole through the wellbore annulus 108.

The DFP system 215 may comprise, for example, the drilling fluid cleaning and reconditioning equipment 170, the solids container 143, and the gas flare stack 174. The DFP system 215 may perform drilling fluid cleaning, reconditioning, and mixing operations.

The MPD system 216 may comprise, for example, the RCD 138, the MPD manifold 152, and the fluid conduit 150. MPD system 216 may be operable to seal the wellbore annulus 108 from the atmosphere via the RCD 138 and restrict the escape of the drilling fluid from the wellbore 102 to thereby apply back pressure to the upper end of the wellbore annulus 108. The RCD 138 permits the drill string 120 to rotate while sealing the wellbore annulus 108 to thereby permit MPD operations.

The WC system 217 may comprise the BOP stack 130, the annular preventer 132, the power unit 137, the CK manifold 156, and the fluid conduit 154. The WC system 217 may be operable to seal the wellbore annulus 108 of the wellbore 102 from the atmosphere and restrict the escape of the drilling fluid (and perhaps formation fluid) from the wellbore 102 to facilitate control of annular pressure of the drilling fluid within the wellbore 102.

Each of the equipment subsystems 211-217 may further comprise various communication devices (e.g., modems, network interface cards, etc.) and communication lines (e.g., cables, conductors, etc.), communicatively connecting sensors and/or actuators of each subsystem 211-217 with a central controller 192 and one or more control workstations 197. Although the equipment listed above and shown in FIG. 1 is associated with certain subsystems 211-217 depicted in FIG. 2, such associations are merely examples that are not intended to limit or prevent such equipment from being associated with two or more subsystems 211-217 and/or different subsystems 211-217.

The rig control system 200 may include various local controllers 221-227 (e.g., processing devices, computers, etc.) each operable to control various equipment of the corresponding subsystem 211-217 and/or an individual piece of equipment of the corresponding subsystem 211-217. As described above, each equipment subsystem 211-217 includes various equipment that may comprise corresponding actuators 241-247 for performing operations of the well construction system 100. Each subsystem 211-217 may include various sensors 231-237 operable to generate or otherwise output sensor data (e.g., signals, information, measurements, etc.) indicative of operational status of the equipment of each subsystem 211-217 and/or indicative of environmental conditions associated with the equipment of each subsystem 211-217. Each local controller 221-227 may output control data (e.g., commands, signals, information, etc.) to one or more actuators 241-247 to perform corresponding actions of a piece of equipment or subsystem 211-217. Each local controller 221-227 may receive sensor data output by one or more sensors 231-237. Although the local controllers 221-227, the sensors 231-237, and the actuators 241-247 are each shown as a single block, it is to be understood that one or more of the local controllers 221-227, the sensors 231-237, and/or the actuators 241-247 may be or comprise a plurality of local controllers, sensors, and/or actuators, respectively.

The sensors 231-237 may include sensors utilized for operation of the various subsystems 211-217 of the well construction system 100. For example, the sensors 231-237 may include cameras, position sensors, speed sensors, acceleration sensors, pressure sensors, force sensors, temperature sensors, flow rate sensors, vibration sensors, electrical current sensors, electrical voltage sensors, resistance sensors, gesture detection sensors or devices, voice actuated or recognition devices or sensors, chemical sensors, exhaust sensors, and/or other examples. The sensor data may include signals, information, and/or measurements indicative of a property (i.e., a parameter) of or associated with a piece of equipment. The sensor data may be indicative of, for example, equipment operational status (e.g., on or off, percent load, up or down, set or released, etc.), equipment operational performance (e.g., flow rate, operational speed, position, pressure, etc.), drilling parameters (e.g., depth, hook load, torque, etc.), auxiliary parameters (e.g., vibration data, temperature, etc.), or environmental conditions (e.g., temperature, pressure, etc.). The acquired sensor data may include or be associated with a timestamp (e.g., date and/or time) indicative of when the sensor data was acquired. The sensor data may also or instead be aligned with a depth or other drilling parameter.

The central controller 192, the control workstations 197, the local controllers 221-227, the sensors 231-237, and the actuators 241-247 may be communicatively connected. The central controller 192 and the control workstations 197 may be communicatively connected to or along a central communication network 202 (e.g., a data bus, a field bus, a wide-area-network (WAN), a local-area-network (LAN), etc.). The local controllers 221-227, the sensors 231-237, and the actuators 241-247 of the corresponding subsystems 211-217 may be communicatively connected to or along a corresponding local communication network 251-257 (e.g., a field bus, a LAN, etc.). Each local communication network 251-257 may be communicatively connected with the central communication network 202 to communicatively connect the central controller 192 with the subsystems 211-217.

The sensor data output by the sensors 231-237 of the subsystems 211-217 may be communicated to the central controller 192 and/or the local controllers 221-227. Similarly, control data output by the central controller 192 and/or the local controllers 221-227 may be communicated to the various actuators 241-247 of the subsystems 211-217, perhaps pursuant to predetermined programming, such as to facilitate well construction operations and/or other operations described herein. Although the central controller 192 is shown as a single device (i.e., a discrete hardware component), it is to be understood that the central controller 192 may be or comprise a plurality of controllers and/or other electronic control devices collectively operable to monitor and control operations (i.e., computational processes or methods) of the well construction system 100. The central controller 192 may be located within or form a portion of the control center 190, although a portion of the central controller 192 may instead be external to the control center 190.

The sensors 231-237 and the actuators 241-247 may be monitored and/or controlled by corresponding local controllers 221-227 and/or the central controller 192. For example, the central controller 192 may be operable to receive sensor data from the sensors 231-237 of the subsystems 211-217 in real-time, and to output real-time control data directly to the actuators 241-247 of the subsystems 211-217 based on the received sensor data. However, certain operations of the actuators 241-247 of each subsystem 211-217 may be controlled by a corresponding local controller 221-227, which may control the actuators 241-247 based on sensor data received from the sensors 231-237 of the corresponding subsystem 211-217 and/or based on control data received from the central controller 192.

The rig control system 200 may be a tiered control system, wherein control of the subsystems 211-217 of the well construction system 100 may be provided via a first tier formed by the local controllers 221-227 and a second tier formed by the central controller 192. The central controller 192 may facilitate control of one or more of the subsystems 211-217 at the level of each individual subsystem 211-217. For example, in the DFP system 215, sensor data may be fed into the local controller 225, which may respond to control the actuators 245. However, for control operations that involve multiple subsystems 211-217, the control may be coordinated through the central controller 192 operable to coordinate control of the equipment of two, three, four, or more (or each) of the subsystems 211-217. For example, coordinated control operations may include the control of downhole pressure during tripping. The downhole pressure may be affected by the DFC system 214 (e.g., pump rate) and the TH system 211 (e.g., tripping speed). Thus, when it is intended to maintain a certain downhole pressure during tripping, the central controller 192 may output control data to two or more of the participating subsystems 211-217.

As described above, the central controller 192 may control various operations of the subsystems 211-217 via analysis of the sensor data from one or more of the subsystems 211-217 to facilitate coordinated control between the subsystems 211-217. The central controller 192 may generate control data to coordinate operations of various equipment of the subsystems 211-217. The control data may include, for example, commands from rig personnel, such as turn on or turn off a pump, switch on or off a fluid valve, or update a physical property setpoint, among other examples. The local controllers 221-227 may each include a fast control loop that directly obtains sensor data and executes, for example, a control algorithm to generate the control data. The central controller 192 may include a slow control loop to periodically obtain sensor data and generate the control data.

The central controller 192 and the local controllers 221-227 may each or collectively operate to receive and store machine-readable and executable program code instructions (e.g., computer program code, algorithms, programmed processes or operations, etc.) on a memory device (e.g., a memory chip) and then execute the program code instructions to run, operate, or perform a control process for monitoring and/or controlling the equipment of the well construction system 100.

The central controller 192 may run (i.e., execute) a central control process 204 (e.g., a coordinated control process) and each local controller 221-227 may run a corresponding local control process. Two or more of the local controllers 221-227 may run their local control processes to collectively coordinate operations between the equipment of two or more of the subsystems 211-217. The control process 204 of the central controller 192 may operate as a mechanization manager of the rig control system 200, coordinating operational sequences of the equipment of the well construction system 100.

The well construction system 100 may also be operated manually by rig personnel 195 (e.g., a driller) via the control workstations 197. The control workstations 197 may be utilized to monitor, configure, control, and/or otherwise operate one or more of the subsystems 211-217 by the rig personnel 195. The control workstations 197 may be communicatively connected with the central controller 192 and/or the local controllers 221-227 via the communication networks 202, 251-257 and may be operable to receive sensor data from the sensors 231-237 and transmit control data to the central controller 192 and/or the local controllers 221-227 to control the actuators 241-247. Accordingly, the control workstations 197 may be utilized by the rig personnel 195 to monitor and control the actuators 241-247 and other portions of the subsystems 211-217 via the central controller 192 and/or local controllers 221-227.

During manual operation of the well construction system 100, the rig personnel may operate as the mechanization manager of the rig control system 200 by manually coordinating operations of various equipment, such as to achieve an intended operational status (or drilling state) of the well construction operations, including tripping in or drilling at an intended rate of penetration (ROP). The control process of each local controller 221-227 may facilitate a lower (e.g., basic) level of control within the rig control system 200 to operate a corresponding piece of equipment or a plurality of pieces of equipment of a corresponding subsystem 211-217. Such control process may facilitate, for example, starting, stopping, and setting or maintaining an operational speed of a piece of equipment. During manual operation of the well construction system 100, the rig personnel 195 manually controls the individual pieces of equipment to achieve the intended operational status of each piece of equipment.

During automatic or semi-automatic operation of the well construction system 100, the control process 204 of the central controller 192 may output control data directly to the actuators 241-247 to control the well construction operations. The control process 204 may also or instead output control data to the local control process of one or more local controllers 221-227, wherein each local control process may then output control data to the actuators 241-247 of the corresponding subsystem 211-217 to control a portion of the well construction operations performed by that subsystem 211-217. Thus, the control processes of the central controller 192 and the local controllers 221-227 of the rig control system 200 individually and collectively perform monitoring and control operations described herein, including monitoring and controlling well construction operations. The program code instructions forming the basis for the control processes described herein may comprise rules (e.g., algorithms) based on the laws of physics for drilling and other well construction operations, among other examples.

Each control process being run by the controllers 192, 221-227 of the rig control system 200 may receive and process (i.e., analyze) sensor data from the sensors 231-237 according to the program code instructions, and may generate control data (i.e., control signals or information) to operate or otherwise control the actuators 241-247 of the equipment. The controllers 192, 221-227 within the scope of the present disclosure can include, for example, programmable logic controllers (PLCs), industrial computers (IPCs), personal computers (PCs), soft PLCs, variable frequency drives (VFDs), and/or other controllers or processing devices operable to store and execute program code instructions, receive sensor data, and output control data to cause operation of the equipment based on the program code instructions, sensor data, and/or control data.

Figure 3:
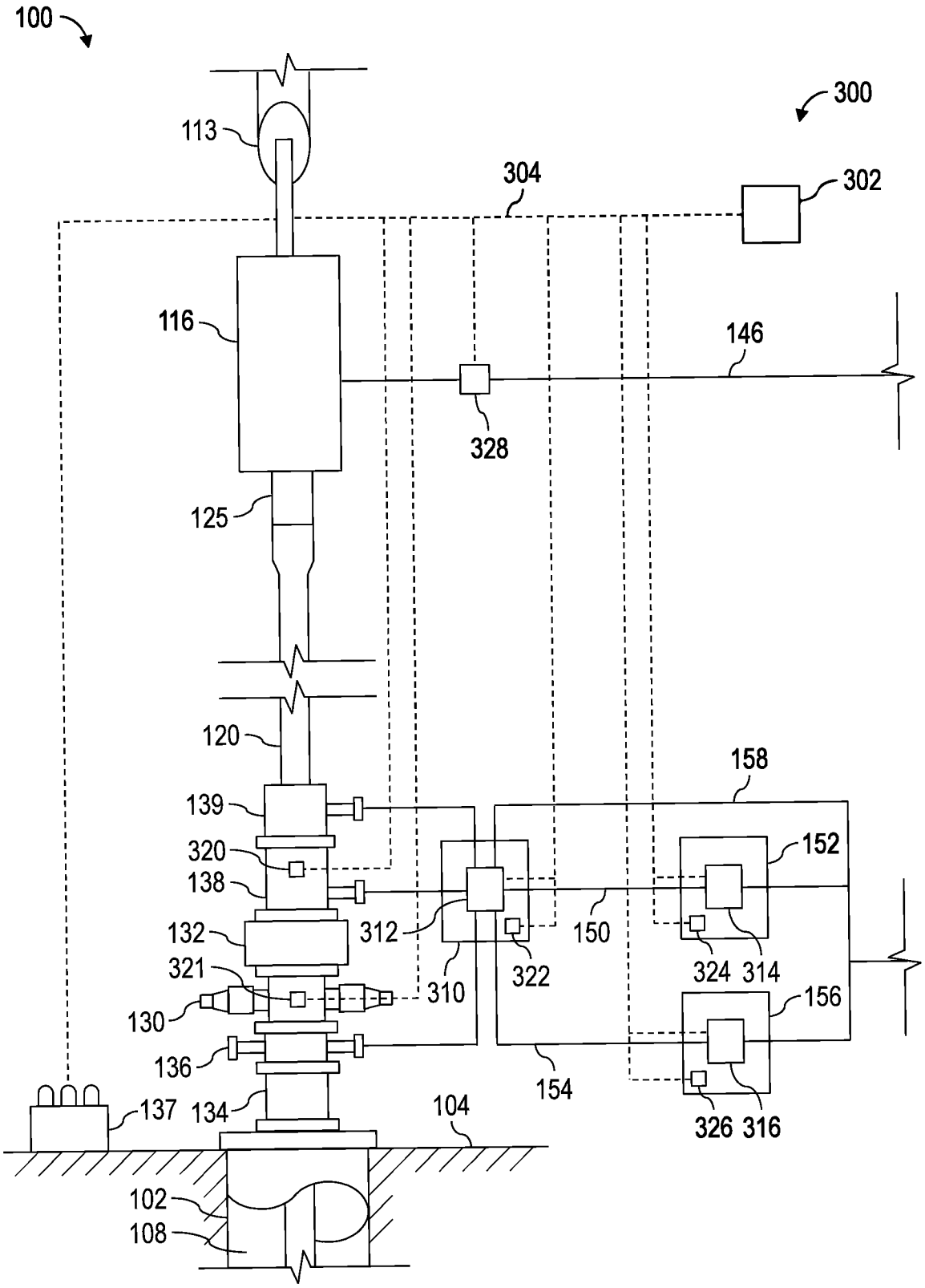
FIG. 3 is a schematic view of at least a portion of an example implementation of apparatus according to one or more aspects of the present disclosure.

FIG. 3 is a schematic view of at least a portion of an example implementation of a control system 300 for monitoring and controlling operation of various portions of the well construction system 100 shown in FIGS. 1 and 2. The control system 300 may form a portion of or operate in conjunction with the well construction system 100 and/or the rig control system 200 shown in FIG. 2. The control system 300 may thus comprise one or more features of the well construction system 100 and/or the rig control system 200, including where indicated by the same reference numerals. Accordingly, the following description refers to FIGS. 1-3, collectively.

The control system 300 may comprise or operate in conjunction with various portions of the well construction system 100, such as the MPD system 216 (e.g., the RCD 138, the power unit 137, and the MPD manifold 152) and the WC system 217 (e.g., the BOP stack 130, the annular preventer 132, the power unit 137, and the CK manifold 156). The control system 300 comprise or operate in conjunction with the power unit 137 to thereby control one or more of the RCD 138, the BOP stack 130, and the annular preventer 132. The control system 300 comprise or operate in conjunction with the MPD manifold 152 and the CK manifold 156 to control annular pressure of fluid (e.g., drilling fluid and/or formation fluid) within the wellbore annulus 108 of the wellbore 102 during MPD operations and well control operations, respectively. The control system 300 may thus be or comprise a wellbore pressure control system 300.

The control system 300 may further comprise or operate in conjunction with a fluid distribution manifold 310 fluidly connected with or along one or more of the fluid conduits 150, 154, 158. The distribution manifold 310 may thus be fluidly connected with one or more of the RCD 138, the ported adapter 136, and the bell nipple 139 and with one or more of the MPD manifold 152, the CK manifold 156, and the drilling fluid cleaning and reconditioning equipment 170. The distribution manifold 310 may be operable to selectively direct the drilling fluid (perhaps containing formation fluid and/or formation cuttings) discharged from the wellbore 102 via one or more of the RCD 138, the ported adapter 136, and the bell nipple 139 to flow through the MPD manifold 152 or the CK manifold 156 to the drilling fluid cleaning and reconditioning equipment 170, or flow directly to the drilling fluid cleaning and reconditioning equipment 170 via the fluid conduit 158.

The distribution manifold 310 may comprise a plurality of fluid control valves 312 fluidly connected with the RCD 138, the ported adapter 136, and the bell nipple 139. The fluid control valves 312 may be collectively operable to direct the flow of the drilling fluid discharged from the wellbore 102 via one of the RCD 138, the ported adapter 136, and the bell nipple 139 through the MPD manifold 152 or the CK manifold 156 to the drilling fluid cleaning and reconditioning equipment 170. The fluid control valves 312 may instead be collectively operable to direct the flow of the drilling fluid discharged from the wellbore 102 directly to the drilling fluid cleaning and reconditioning equipment 170 via the fluid conduit 158. For example, the fluid control valves 312 may direct the drilling fluid flowing out of the RCD 138 to flow through the fluid conduit 150 and the MPD manifold 152 or to flow through the fluid conduit 154 and the CK manifold 156. The fluid control valves 312 may instead direct the drilling fluid flowing out of the ported adapter 136 to flow through the fluid conduit 154 and the CK manifold 156. The fluid control valves 312 may be or comprise fluid directional control valves (e.g., three-way flow valves) and/or flow shutoff valves (e.g., gate valves, ball valves, etc.) collectively operable to control direction of fluid flow. The fluid control valves 312 may be or comprise remotely operated fluid control valves 312, each comprising a remotely (e.g., electrically, hydraulically, etc.) operated actuator (e.g., an electric motor, an electric coil, etc.) (not shown) configured to operate (e.g., open, close, change the position of, etc.) a corresponding valve 312 based on received control data (i.e., a control signal).

The MPD manifold 152 may comprise one or more fluid chokes 314 fluidly connected along the fluid conduit 150 and collectively operable to control the rate of the drilling fluid flowing through the MPD manifold 152. The chokes 314 may generate backpressure along the fluid conduit 150 and the upper end of the wellbore annulus 108 to control pressure along the entire wellbore annulus 108 extending from the upper end of the wellbore annulus 108 (e.g., at the RCD 138) to the drill bit 126. Each choke 314 may variably restrict the flow of the drilling fluid flowing therethrough to thereby variably control the rate of the drilling fluid flowing through the MPD manifold 152. The greater the restriction to flow through each choke 314, the greater the backpressure applied to the upper end of the wellbore annulus 108. The chokes 314 may be or comprise remotely operable chokes 314, each comprising a remotely operated actuator (not shown) configured to operate (i.e., change the position of) the choke 314 based on received control data.

The CK manifold 156 may comprise one or more fluid chokes 316 fluidly connected along the fluid conduit 154 and collectively operable to control the rate of the drilling fluid flowing through the CK manifold 156. The chokes 316 may generate backpressure along the fluid conduit 154 and an upper end of the wellbore annulus 108 to control pressure along the entire wellbore annulus 108 extending from the upper end of the wellbore annulus 108 (e.g., at the BOP stack 130 or the RCD 138) to the drill bit 126. Each choke 314 may variably restrict the flow of the drilling fluid flowing therethrough to thereby control the rate of the drilling fluid flowing through the CK manifold 156. The greater the restriction to flow through each choke 316, the greater the backpressure applied to the upper end of the wellbore annulus 108. The chokes 316 may be or comprise remotely operable chokes 316, each comprising a remotely operated actuator (not shown) configured to operate the choke 316 based on received control data.

The control system 300 may further comprise a plurality of sensors 320, 321, 322, 324, 326, 328, each operable to generate, output, or otherwise facilitate sensor measurements (e.g., data, signals, information, etc.) indicative of a property associated with a piece of equipment. For example, one or more of the sensors 320, 321, 322, 324, 326, 328 may be operable to facilitate fluid measurements indicative of a property (e.g., pressure, flow, etc.) of the fluid within the wellbore 102, the fluid flowing into the wellbore 102 via the internal fluid passage 121, and/or the fluid flowing out of the wellbore 102 via one or more of the ported adapter 136, the RCD 138, and the manifolds 152, 156, 310. One or more of the sensors 320, 321, 322, 324, 326, 328 may also or instead be operable to facilitate operational measurements (e.g., position, speed, etc.) indicative of an operational status or performance of a corresponding piece of equipment. One or more of the sensors 320, 321, 322, 324, 326, 328 may also or instead be operable to facilitate environmental measurements (e.g., pressure, temperature, etc.) indicative of the environment associated with a corresponding piece of equipment.

The sensors 320 may be or comprise a fluid flow rate sensor fluidly or otherwise operatively connected in association with the RCD 138 and/or otherwise upstream from the distribution manifold 310. The flow rate sensor may be operable to generate, output, or otherwise facilitate fluid flow rate measurements indicative of the volumetric and/or mass flow rate of the fluid being discharged out of the wellbore 102 via the RCD 138 during MPD operations. The flow rate sensor may be an electrical flow rate sensor operable to output electrical flow rate data indicative of the flow rate. The flow rate sensor may be a Coriolis flowmeter, a turbine flowmeter, or an acoustic flowmeter, among other examples. The sensors 320 may also or instead be or comprise a fluid pressure sensor fluidly or otherwise operatively connected in association with the RCD 138 and/or otherwise upstream from the distribution manifold 310. The pressure sensor may be operable to generate, output, or otherwise facilitate fluid pressure measurements indicative of the pressure of the fluid at the upper end of the wellbore annulus 108 and being discharged out of the wellbore 102 via the RCD 138 during MPD operations. The pressure sensor may be an electrical pressure sensor operable to output electrical pressure data indicative of the fluid pressure. The sensors 320 may also or instead be or comprise one or more position sensors operatively connected in association with the RCD 138. Each position sensor may be operable to generate, output, or otherwise facilitate position measurements indicative of an operational position or status (e.g., open, closed, etc.) of the RCD 138. The position measurements may thus be indicative of when the RCD 138 is open, such as during normal drilling operations, and when the RCD 138 is closed, such as during MPD operations. The position sensors may be electrical position sensors each operable to output electrical position data indicative of an operational position or status of the RCD 138.

The sensors 321 may be or comprise a fluid pressure sensor fluidly or otherwise operatively connected in association with one or more of the annular preventer 132 and the BOP stack 130. The pressure sensor may be operable to generate, output, or otherwise facilitate fluid pressure measurements indicative of the pressure of the fluid at the upper end of the wellbore annulus 108 and being discharged out of the wellbore 102 via the bell nipple 139, the RCD 138, or the ported adapter 136. The pressure sensor may be an electrical pressure sensor operable to output electrical pressure data indicative of the fluid pressure. The sensors 321 may also or instead be or comprise one or more position sensors operatively connected in association with one or more of the annular preventer 132 and the BOP stack 130. Each position sensor may be operable to generate, output, or otherwise facilitate position measurements indicative of an operational position or status (e.g., open, closed, etc.) of one or more of the annular preventer 132 and the BOP stack 130. The position measurements may thus be indicative of when one or more of the annular preventer 132 and the BOP stack 130 is open, such as during regular drilling operations or MPD operations, and when one or more of the annular preventer 132 and the BOP stack 130 is closed, such as during well control operations. The position sensors may be electrical position sensors each operable to output electrical position data indicative of an operational position or status of one or more of the annular preventer 132 and the BOP stack 130.

The sensors 322 may be or comprise a fluid flow rate sensor fluidly or otherwise operatively connected in association with the distribution manifold 310. The flow rate sensor may be operable to generate, output, or otherwise facilitate fluid flow rate measurements indicative of the volumetric and/or mass flow rate of the fluid being discharged out of the wellbore 102 via the bell nipple 139 during normal (e.g., overbalanced) drilling operations, via the RCD 138 during MPD operations, or via the ported adapter 136 during well control operations. The flow rate sensor may be an electrical flow rate sensor operable to output electrical flow rate data indicative of the flow rate. The sensors 322 may also or instead be or comprise a fluid pressure sensor fluidly or otherwise operatively connected in association with the distribution manifold 310. The pressure sensor may be operable to generate, output, or otherwise facilitate fluid pressure measurements indicative of the pressure of the fluid at the upper end of the wellbore annulus 108 and being discharged out of the wellbore 102 via the bell nipple 139, the RCD 138, or the ported adapter 136. The pressure sensor may be an electrical pressure sensor operable to output electrical pressure data indicative of the fluid pressure. The sensors 322 may also or instead be or comprise one or more position sensors operatively connected in association with one or more of the fluid control valves 312 (or actuators thereof) of the distribution manifold 310. Each position sensor may be operable to generate, output, or otherwise facilitate position measurements indicative of an operational position (e.g., open, closed, direction, etc.) of one or more of the fluid control valves 312. The position measurements may thus be indicative of the direction (i.e., through which of the fluid conduits 150, 154, 150) that the fluid control valves 312 are configured to transmit the fluid discharged from the wellbore 102. For example, the position measurements may indicate that the fluid control valves 312 are configured to transmit the fluid discharged from the wellbore 102 through the fluid conduit 158, the MPD manifold 152, or the CK manifold 156. The position sensors may be electrical position sensors each operable to output electrical position data indicative of a position of a corresponding fluid control valve 312.

The sensors 324 may be or comprise a fluid flow rate sensor fluidly or otherwise operatively connected in association with the MPD manifold 152. The flow rate sensor may be operable to generate, output, or otherwise facilitate fluid flow rate measurements indicative of the volumetric and/or mass flow rate of the fluid being discharged out of the wellbore 102 via the RCD 138 during MPD operations. The flow rate sensor may be an electrical flow rate sensor operable to output electrical flow rate measurements indicative of the flow rate. The sensors 322 may also or instead be or comprise a fluid pressure sensor fluidly or otherwise operatively connected in association with the MPD manifold 152. The pressure sensor may be operable to generate, output, or otherwise facilitate fluid pressure measurements indicative of an amount of backpressure that the MPD manifold 152 is applying to the upper end of the wellbore 102. The pressure sensor may be an electrical pressure sensor operable to output electrical pressure measurements indicative of the fluid pressure. The sensors 322 may also or instead be or comprise one or more position sensors each operatively connected in association with a corresponding choke 314 (or actuators thereof) of the MPD manifold 152. Each position sensor may be operable to generate, output, or otherwise facilitate position measurements indicative of an operational position (e.g., the amount open) of a corresponding choke 314. The position measurements may thus indicate the amount (e.g., the percentage) by which the choke 314 is restricting the flow of fluid through the MPD manifold 152 during MPD operations. The position sensors may be electrical position sensors each operable to output electrical position data indicative of a position of a corresponding choke 314.

The sensors 326 may be or comprise a fluid flow rate sensor fluidly or otherwise operatively connected in association with the CK manifold 156. The flow rate sensor may be operable to generate, output, or otherwise facilitate fluid flow rate measurements indicative of the volumetric and/or mass flow rate of the fluid being discharged out of the wellbore 102 via the RCD 138 and/or the ported adapter 136 during well control operations. The flow rate sensor may be an electrical flow rate sensor operable to output electrical flow rate data indicative of the flow rate. The sensors 322 may also or instead be or comprise a fluid pressure sensor fluidly or otherwise operatively connected in association with the CK manifold 156. The pressure sensor may be operable to generate, output, or otherwise facilitate fluid pressure measurements indicative of an amount of backpressure that the CK manifold 156 is applying to the upper end of the wellbore annulus 108. The pressure sensor may be an electrical pressure sensor operable to output electrical pressure data indicative of the fluid pressure. The sensors 322 may also or instead be or comprise one or more position sensors, each operatively connected in association with a corresponding choke 316 (or actuators thereof) of the CK manifold 156. Each position sensor may be operable to generate, output, or otherwise facilitate position measurements indicative of an operational position (e.g., the amount open) of a corresponding choke 316. The position measurements may thus indicate the amount (e.g., the percentage) by which the choke 316 is restricting the flow of fluid through the CK manifold 156 during well control operations. The position sensors may be electrical position sensors each operable to output electrical position data indicative of a position of a corresponding choke 316.

The sensors 328 may be or comprise a fluid flow rate sensor fluidly connected with or along the fluid conduit 146. The flow rate sensor may be operable to generate, output, or otherwise facilitate fluid flow rate measurements indicative of the volumetric and/or mass flow rate of the drilling fluid being injected into the wellbore 102 via the internal passage 121 of the drill string 120 during normal drilling operations, MPD operations, or well control operations. The flow rate sensor may be an electrical flow rate sensor operable to output electrical flow rate data indicative of the flow rate. The sensors 328 may also or instead be or comprise a fluid pressure sensor fluidly connected with or along the fluid conduit 146. The pressure sensor may be operable to generate, output, or otherwise facilitate fluid pressure measurements indicative of the pressure of the drilling fluid at the upper end of the drill string 120 that is being injected into the wellbore 102 via the drill string 120 during normal drilling operations, MPD operations, or well control operations. The pressure sensor may be an electrical pressure sensor operable to output electrical pressure data indicative of the fluid pressure.

The control system 300 may comprise a controller 302, such as, for example, a PLC, a PC, an IPC, or other information processing devices equipped with control logic. The controller 302 may be operable to receive, process, and output various sensor measurements to monitor operations of and provide control to one or more portions of the well construction system 100. The controller 302 may be communicatively connected with one or more of the sensors 320, 321, 322, 324, 326, 328 and may be operable to receive sensor measurements (or sensor data) facilitated (e.g., output) by one or more of the sensors 320, 321, 322, 324, 326, 328. The controller 302 may be communicatively connected with the power unit 137 and may be operable to transmit control data (i.e., control commands) to the power unit 137 to control the operational status of one or more of the BOP stack 130, the annular preventer 132, and the RCD 138 to perform various operations described herein, including switching between normal drilling operations, MPD operations, and well control operations. The controller 302 may also be communicatively connected with one or more of the manifolds 152, 156, 310 and may be operable to transmit control data to the manifolds 152, 156, 310 to perform various operations described herein, including switching between normal drilling operations, MPD operations, and well control operations. Communication between the processing device 302 and the manifolds 152, 156, 310, the power unit 137, and the sensors 320, 321, 322, 324, 326, 328 may be performed via wired and/or wireless communication means 304.

The controller 302 may comprise a memory operable to store executable computer program code (e.g., instructions) and/or operational parameter setpoints, including for implementing one or more aspects of methods and operations described herein. The controller 302 may receive the sensor measurements, process the sensor measurements, generate the control data based on the sensor measurements, the computer program code, and the operational parameter setpoints, and output the control data to the manifolds 152, 156, 310 to implement one or more aspects of the methods and operations described herein.

As described above, the control system 300 may be or comprise at least a portion of the rig control system 200, including at least a portion of the MPD system 216 and the WC system 217. Thus, the controller 302 of the control system 300 may be or comprise at least a portion of the local controller 226 of the MPD system 216, the local controller 227 of the WC system 217, and/or the central controller 192. Also, the communication means 304 may be or comprise at least a portion of the local communication networks 256, 257 and/or the central communication network 202.

Figure 4:
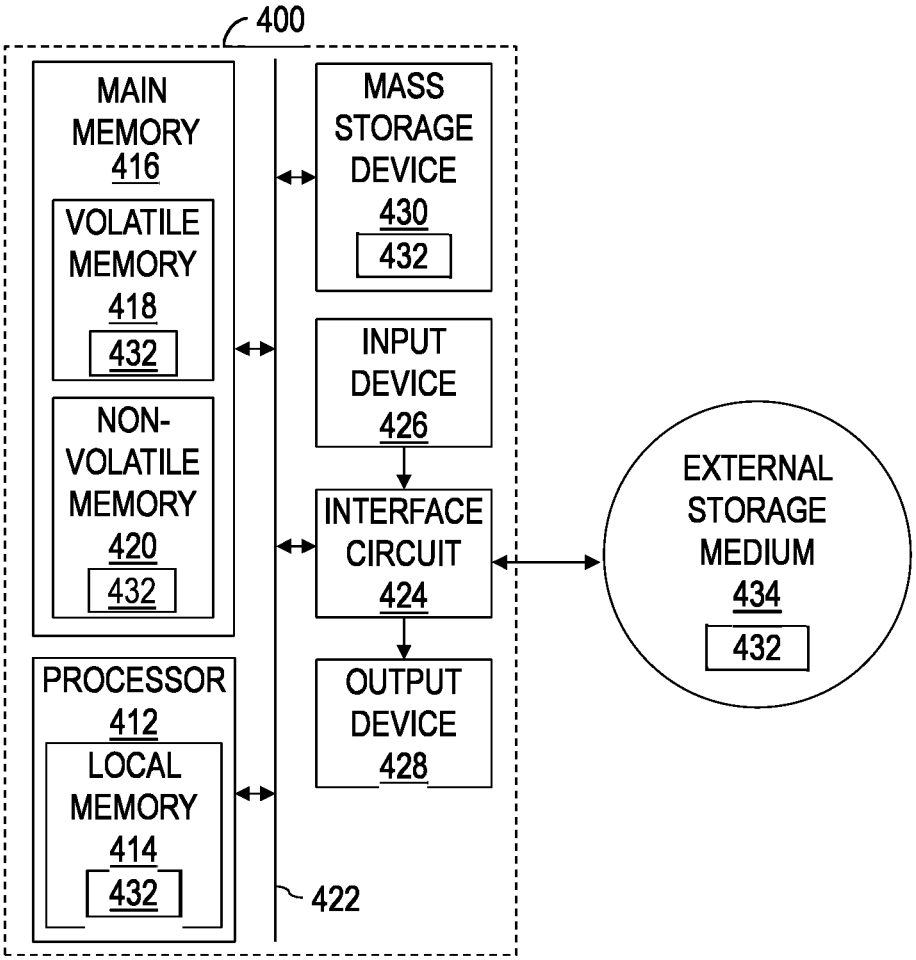
FIG. 4 is a schematic view of at least a portion of an example implementation of apparatus according to one or more aspects of the present disclosure.

FIG. 4 is a schematic view of at least a portion of an example implementation of a processing device 400 (or system) according to one or more aspects of the present disclosure. The processing device 400 may be or form at least a portion of one or more equipment controllers and/or other electronic devices shown in one or more of the FIGS. 1-3. Accordingly, the following description refers to FIGS. 1-4, collectively.

The processing device 400 may be or comprise, for example, one or more processors, controllers, special-purpose computing devices, PCs (e.g., desktop, laptop, and/or tablet computers), personal digital assistants, smartphones, IPCs, PLCs, servers, internet appliances, and/or other types of computing devices. The processing device 400 may be or form at least a portion of the rig control system 200, including the central controller 192, the local controllers 221-227, and the control workstations 197. The processing device 400 may be or form at least a portion of the wellbore pressure control system 300, including the controller 302. Although it is possible that the entirety of the processing device 400 is implemented within one device, it is also contemplated that one or more components or functions of the processing device 400 may be implemented across multiple devices, some or an entirety of which may be at the wellsite and/or remote from the wellsite.

The processing device 400 may comprise a processor 412, such as a general-purpose programmable processor. The processor 412 may comprise a local memory 414, and may execute machine-readable computer program code 432 (i.e., computer program instructions) present in the local memory 414 and/or other memory device. The processor 412 may be, comprise, or be implemented by one or more processors of various types suitable to the local application environment, and may include one or more of general-purpose computers, special-purpose computers, microprocessors, digital signal processors (DSPs), field-programmable gate arrays (FPGAs), application-specific integrated circuits (ASICs), and processors based on a multi-core processor architecture, as non-limiting examples. Examples of the processor 412 include one or more INTEL microprocessors, microcontrollers from the ARM and/or PICO families of microcontrollers, embedded soft/hard processors in one or more FPGAs.

The processor 412 may execute, among other things, the computer program code 432 and/or other instructions and/or programs to implement the example methods and/or operations described herein. For example, the computer program code 432, when executed by the processor 412 of the processing device 400, may cause the processor 412 to receive and process (e.g., compare) sensor data (or sensor measurements). The computer program code 432, when executed by the processor 412 of the processing device 400, may also or instead output control data (i.e., control commands) to cause one or more portions or pieces of well construction equipment of the well construction system 100 to perform the example methods and/or operations described herein.

The processor 412 may be in communication with a main memory 416, such as may include a volatile memory 418 and a non-volatile memory 420, perhaps via a bus 422 and/or other communication means. The volatile memory 418 may be, comprise, or be implemented by random-access memory (RAM), static RAM (SRAM), dynamic RAM (DRAM), synchronous DRAM (SDRAM), RAMBUS DRAM (RDRAM), and/or other types of RAM devices. The non-volatile memory 420 may be, comprise, or be implemented by read-only memory, flash memory, and/or other types of memory devices. One or more memory controllers (not shown) may control access to the volatile memory 418 and/or non-volatile memory 420.

The processing device 400 may also comprise an interface circuit 424, which is in communication with the processor 412, such as via the bus 422. The interface circuit 424 may be, comprise, or be implemented by various types of standard interfaces, such as an Ethernet interface, a universal serial bus (USB), a third generation input/output (3GIO) interface, a wireless interface, a cellular interface, and/or a satellite interface, among others. The interface circuit 424 may comprise a graphics driver card. The interface circuit 424 may comprise a communication device, such as a modem or network interface card to facilitate exchange of data with external computing devices via a network (e.g., Ethernet connection, digital subscriber line (DSL), telephone line, coaxial cable, cellular telephone system, satellite, etc.).

The processing device 400 may be in communication with various sensors, video cameras, actuators, processing devices, equipment controllers, and other devices of the well construction system via the interface circuit 424. The interface circuit 424 can facilitate communications between the processing device 400 and one or more devices by utilizing one or more communication protocols, such as an Ethernet-based network protocol (such as ProfiNET, OPC, OPC/UA, Modbus TCP/IP, EtherCAT, UDP multicast, Siemens S7 communication, or the like), a proprietary communication protocol, and/or other communication protocol.

One or more input devices 426 may also be connected to the interface circuit 424. The input devices 426 may permit rig personnel to enter the computer program code 432, which may be or comprise executable computer program code and operational parameter setpoints. The computer program code 432 may further comprise modeling or predictive routines, equations, algorithms, processes, applications, and/or other programs operable to perform example methods and/or operations described herein. The input devices 426 may be, comprise, or be implemented by a keyboard, a mouse, a joystick, a touchscreen, a track-pad, a trackball, an isopoint, and/or a voice recognition system, among other examples. One or more output devices 428 may also be connected to the interface circuit 424. The output devices 428 may permit visualization or other sensory perception of various data, such as sensor data, status data, and/or other example data. The output devices 428 may be, comprise, or be implemented by video output devices (e.g., a liquid crystal display (LCD), a light-emitting diode (LED) display, a cathode ray tube (CRT) display, a touchscreen, etc.), printers, and/or speakers, among other examples. The one or more input devices 426 and the one or more output devices 428 connected to the interface circuit 424 may, at least in part, facilitate the HMIs described herein.

The processing device 400 may comprise a mass storage device 430 for storing data and computer program code 432. The mass storage device 430 may be connected to the processor 412, such as via the bus 422. The mass storage device 430 may be or comprise a tangible, non-transitory storage medium, such as a floppy disk drive, a hard disk drive, a compact disk (CD) drive, and/or digital versatile disk (DVD) drive, among other examples. The processing device 400 may be communicatively connected with an external storage medium 434 via the interface circuit 424. The external storage medium 434 may be or comprise a removable storage medium (e.g., a CD or DVD), such as may be operable to store data and computer program code 432.

As described above, the computer program code 432 may be stored in the mass storage device 430, the main memory 416, the local memory 414, and/or the removable storage medium 434. Thus, the processing device 400 may be implemented in accordance with hardware (perhaps implemented in one or more chips including an integrated circuit, such as an ASIC), or may be implemented as software or firmware for execution by the processor 412. In the case of firmware or software, the implementation may be provided as a computer program product including a non-transitory, computer-readable medium or storage structure embodying computer program code 432 thereon for execution by the processor 412. The computer program code 432, when executed by the processor 412, may perform and/or cause performance of example methods, processes, and/or operations described herein.

The present disclosure is further directed to example methods (e.g., operations and/or processes) that can be performed to facilitate automatic switching between MPD operations and well control operations based on conditions detected within the wellbore. The methods may be performed by utilizing (or otherwise in conjunction with) at least a portion of one or more implementations of one or more instances of the apparatus shown in one or more of FIGS. 1-4, and/or otherwise within the scope of the present disclosure. The methods may be caused to be performed, at least partially, by a controller (e.g., the controller 302) executing computer program code according to one or more aspects of the present disclosure. Thus, the present disclosure is also directed to a non-transitory, computer-readable medium comprising computer program code that, when executed by the controller, may cause such controller to perform the example methods described herein. The methods may also or instead be caused to be performed, at least partially, by a human operator (e.g., rig personnel) utilizing one or more instances of the apparatus shown in one or more of FIGS. 1-4, and/or otherwise within the scope of the present disclosure. Thus, the following description of example methods refer to apparatus shown in one or more of FIGS. 1-4. However, the methods may also be performed in conjunction with implementations of apparatus other than those depicted in FIGS. 1-4 that are also within the scope of the present disclosure.

An example method according to one or more aspects of the present disclosure comprises using the control system 300 to perform MPD operations while monitoring conditions (e.g., pressure) within the wellbore 102, automatically switch from MPD operations to perform well control operations based on the conditions detected within the wellbore 102 while continuing to monitor conditions within the wellbore 102, and then automatically switch back from well control operations to perform MPD operations based on subsequent conditions detected within the wellbore 102. An example method according to one or more aspects of the present disclosure also or instead comprises using the control system 300 to perform MPD operations while monitoring operational status (e.g., open, closed, etc.) of the RCD 138 and the BOP stack 130, automatically switch direction of fluid being discharged from the wellbore 102 via the ported adapter 136 to flow through the CK manifold 156 after the BOP stack 130 closes to perform well control operations, and then automatically switch back from well control operations to perform MPD operations based on subsequent operational status of the RCD 138 and the BOP stack 130.

For example, the controller 302 of the control system 300 may receive and monitor operational measurements (or sensor data) facilitated by one or more of the sensors 320, 321, 322, 324, 326, 328 and, based on such operational measurements, cause the distribution manifold 310 to direct the fluid discharged out of the wellbore 102 via the RCD 138 to flow through the MPD manifold 152 to thereby permit the MPD manifold 152 to control the pressure of the fluid (perhaps containing formation cuttings) within the wellbore 102 during MPD operations. The controller 302 of the control system 300 may receive and monitor the operational measurements facilitated by one or more of the sensors 320, 321, 322, 324, 326, 328 and, based on such operational measurements, cause the distribution manifold 310 to direct the fluid discharged out of the wellbore 102 via the RCD 138 to flow through the CK manifold 156 to thereby permit the CK manifold 156 to control the pressure of the fluid (perhaps containing formation cuttings and/or formation fluid) within the wellbore 102 during well control operations. The controller 302 of the control system 300 may receive and monitor the operational measurements facilitated by one or more of the sensors 320, 321, 322, 324, 326, 328 and, based on such operational measurements, cause the distribution manifold 310 to direct the fluid discharged out of the wellbore 102 via the ported adapter 136 after the BOP stack 130 closes to flow through the CK manifold 156 to thereby permit the CK manifold 156 to control the pressure of the fluid (perhaps containing formation cuttings and/or formation fluid) within the wellbore 102 during well control operations.

The controller 302 may cause the power unit 137 to close the RCD 138 and cause the distribution manifold 310 to direct the fluid discharged via the RCD 138 to flow through the MPD manifold 152 to perform MPD operations. The controller 302 may instead cause the power unit 137 to close the RCD 138 and cause the distribution manifold 310 to direct the fluid discharged via the RCD 138 to flow through the CK manifold 156 to perform well control operations, such as, for example, when pressure of the fluid at top of the wellbore 102 is below a predetermined pressure (e.g., 7,500 pounds per square inch (PSI)). The controller 302 may instead cause the power unit 137 to close one or more rams of the BOP stack 130 and cause the distribution manifold 310 to direct the fluid discharged via the ported adapter 136 to flow through the CK manifold 156 to perform well control operations, such as, for example, when pressure of the fluid at top of the wellbore 102 is above the predetermined pressure.

When the controller 302 causes the distribution manifold 310 to direct the fluid discharged out of the wellbore 102 via the RCD 138 to flow through the MPD manifold 152, the controller 302 may then control the choke 314 of the MPD manifold 152 to control the flow rate of the fluid discharged from the wellbore 102 to thereby control the pressure of the fluid within the wellbore 102 to perform MPD operations. When the controller 302 causes the distribution manifold 310 to direct the drilling fluid discharged out of the wellbore 102 via the RCD 138 or the ported adapter 136 to flow through the CK manifold 156, the controller 302 may then control the choke 316 of the CK manifold 156 to control the flow rate of the fluid discharged from the wellbore 102 to thereby control the pressure of the drilling fluid within the wellbore 102 to perform well control operations.

The controller 302 of the control system 300 may receive the operational measurements facilitated by one or more of the sensors 320, 321, 322, 324, 326, 328 and monitor the operational measurements to detect an influx of formation fluid (i.e., a kick) into the wellbore annulus 108 of the wellbore 102 based on such operational measurements. After the controller 302 detects the influx of formation fluid, the controller 302 may then cause the distribution manifold 310 to stop directing the fluid discharged out of the wellbore 102 via the RCD 138 to flow through the MPD manifold 152 during MPD operations. The controller 302 may then cause the distribution manifold 310 to direct the fluid discharged out of the wellbore 102 via the RCD 138 to flow through the CK manifold 156 to thereby permit the CK manifold 156 to control the pressure of the fluid (drilling fluid and formation fluid) within the wellbore 102 during well control operations. However, when the BOP stack 130 closes, the controller 302 may then cause the distribution manifold 310 to direct the fluid discharged out of the wellbore 102 via the ported adapter 136 to flow through the CK manifold 156 to thereby permit the CK manifold 156 to control the pressure of the fluid within the wellbore 102 during well control operations.

The sensor measurements facilitated by one or more of the sensors 320, 321, 322, 324, 326, 328 may be or comprise fluid measurements indicative of a property of the fluid at the upper end of the wellbore annulus 108 and/or being discharged out of the wellbore 102. For example, one or more of the sensors 320, 321, 322, 324, 326, 328 may be or comprise fluid pressure sensors operable to facilitate fluid pressure measurements indicative of the pressure of the fluid at the upper end of the wellbore annulus 108 and/or being discharged out of the wellbore 102 via the RCD 138 or the ported adapter 136. The fluid measurements may thus be or comprise fluid pressure measurements. One or more of the sensors 320, 321, 322, 324, 326, 328 may also or instead be or comprise fluid flow rate sensors operable to facilitate fluid flow rate measurements indicative of the flow rate of the fluid being discharged out of the wellbore 102 via the RCD 138 or the ported adapter 136. The fluid measurements may thus be or comprise fluid flow rate measurements.

An influx of formation fluid into the wellbore 102 may be detected based on a relationship between fluid measurements of a property of the fluid at the upper end of the wellbore annulus 108 and/or being discharged out of the wellbore 102 and a predetermined threshold of such property of the fluid. For example, the controller 302 may be operable to cause the distribution manifold 310 to direct the fluid discharged out of the wellbore 102 via the RCD 138 to flow through the MPD manifold 152 when the fluid measurements indicate that the property of the fluid is below a first predetermined threshold to thereby permit the MPD manifold 152 to control the pressure of the fluid within the wellbore 102 during MPD operations. The controller 302 may be further operable to cause the distribution manifold 310 to direct the fluid discharged out of the wellbore 102 via the RCD 138 to flow through the CK manifold 156 when the fluid measurements indicate that the property of the fluid is above the first predetermined threshold to thereby permit the CK manifold 156 to control the pressure of the fluid within the wellbore 102 during well control operations. The controller 302 may be further operable to cause the BOP stack 130 to close and cause the distribution manifold 310 to direct the fluid discharged out of the wellbore 102 via the ported adapter 136 to flow through the CK manifold 156 when the fluid measurements indicate that the property of the fluid is above a second predetermined threshold to thereby permit the CK manifold 156 to control the pressure of the fluid within the wellbore 102 during well control operations.

An influx of formation fluid into the wellbore 102 may be detected based on a relationship between fluid flow rate measurements indicative of the flow rate of drilling fluid being injected into the wellbore 102 via the drill string 120 and fluid flow rate measurements indicative of the flow rate of fluid (drilling fluid and/or formation fluid) being discharged out of the wellbore 102. For example, the controller 302 may be operable to receive first fluid flow rate measurements indicative of a first flow rate facilitated by one or more of the sensors 320, 322, 324 and second fluid flow rate measurements indicative of a second flow rate facilitated by the sensors 328, determine a flow rate difference between the first flow rate and the second flow rate, and cause the distribution manifold 310 to direct the fluid being discharged out of the wellbore 102 via the RCD 138 to flow through one of the MPD manifold 152 and the CK manifold 156 based on the flow rate difference. The controller 302 may be operable to, when the first flow rate is greater than the second flow rate by a predetermined flow rate difference, cause the distribution manifold 310 to stop directing the fluid being discharged out of the wellbore 102 via the RCD 138 to flow through the MPD manifold 152, and cause the distribution manifold 310 to direct the fluid being discharged out of the wellbore 102 via the RCD 138 to instead flow through the CK manifold 156 to thereby permit the CK manifold 156 to control the pressure of the fluid within the wellbore 102 during well control operations. The controller 302 may instead be operable to, when the first flow rate is greater than the second flow rate by a predetermined flow rate difference, cause the BOP stack 130 to close and cause the distribution manifold 310 to direct the fluid being discharged out of the wellbore 102 via the ported adapter 136 to flow through the CK manifold 156 to thereby permit the CK manifold 156 to control the pressure of the fluid within the wellbore 102 during well control operations.

An influx of formation fluid into the wellbore 102 may be detected based on position measurements indicative of a position of a choke 314 of the MPD manifold 152 facilitated by position sensors 324. For example, the controller 302 may be operable to receive and monitor the position measurements facilitated by the position sensors 324. When the position measurements indicate that the position of the choke 314 of the MPD manifold 152 changes at a frequency and/or magnitude that is/are above a predetermined threshold, the controller 302 may be operable to cause well control operations to be performed. For example, the controller 302 may cause the distribution manifold 310 to stop directing the fluid (drilling fluid and formation fluid) discharged out of the wellbore 102 via the RCD 138 to flow through the MPD manifold 152, and cause the distribution manifold 310 to direct the fluid discharged out of the wellbore 102 via the RCD 138 to instead flow through the CK manifold 156 to thereby permit the CK manifold 156 to control the pressure of the fluid within the wellbore 102 during well control operations. The controller 302 may instead cause the BOP stack 130 to close and cause the distribution manifold 310 to direct the fluid (drilling fluid and formation fluid) discharged out of the wellbore 102 via the ported adapter 136 to flow through the CK manifold 156 to thereby permit the CK manifold 156 to control the pressure of the fluid within the wellbore 102 during well control operations.

An influx of formation fluid into the wellbore 102 may be detected based on rate of change of a property of the fluid being discharged out of the wellbore 102. For example, the controller 302 may be operable to, when the fluid measurements indicate that the property of the fluid is at steady state, cause the distribution manifold 310 to direct the fluid (drilling fluid) discharged out of the wellbore 102 to flow through the MPD manifold 152 to thereby permit the MPD manifold 152 to control the pressure of the fluid within the wellbore 102 during MPD operations. The controller 302 may be further operable to cause well control operations to be performed. For example, when the fluid measurements indicate that the property of the fluid is fluctuating (i.e., not at steady state), the controller 302 may cause the distribution manifold 310 to direct the fluid (drilling fluid and formation fluid) discharged out of the wellbore 102 via the RCD 138 to instead flow through the CK manifold 156 to thereby permit the CK manifold 156 to control the pressure of the fluid within the wellbore 102 during well control operations. The controller 302 may instead cause the BOP stack 130 to close and cause the distribution manifold 310 to direct the fluid (drilling fluid and formation fluid) discharged out of the wellbore 102 via the ported adapter 136 to flow through the CK manifold 156 to thereby permit the CK manifold 156 to control the pressure of the fluid within the wellbore 102 during well control operations. Steady state of operational or environmental measurements may be defined as normal operational or environmental measurements associated with normal drilling or MPD operations that were recorded before the influx of formation fluid into the wellbore 102 was detected. Steady state of operational or environmental measurements may instead be defined as normal operational or environmental measurements that are expected during normal drilling or MPD operations when there is no influx of formation fluid into the wellbore 102. Steady state of operational or environmental measurements may be assumed to be reached when detected operational or environmental measurements fluctuate by less than 1%, 2%, 5%, 10%, or 15% over a predetermined period of time, such as 10 seconds, 30 seconds, one minute, two minutes, or five minutes.

The controller 302 may be further operable to continue to monitor the sensor measurements to determine when the influx of formation fluid into the wellbore 102 stops and/or when the formation fluid (e.g., a gas pocket) is discharged from the wellbore 102 via the CK manifold 156 during well control operations. The controller 302 may be operable to determine when the influx of formation fluid into the wellbore 102 stops and/or when the formation fluid is discharged from the wellbore 102 based on sensor measurements, such as fluid measurements (e.g., fluid pressure measurements and/or fluid flow rate measurements) and/or operational measurements (e.g., choke position measurements). The controller 302 may be operable to determine when the influx of formation fluid into the wellbore 102 stops and/or when the formation fluid is discharged from the wellbore 102, for example, when the fluid measurements indicate that the property of the fluid is below the predetermined threshold, when the first flow rate and the second flow rate are about equal, when the first flow rate is greater than the second flow rate by less than the predetermined flow rate difference, when the position measurements indicate that the position of the choke 314 of the MPD manifold 152 changes at a frequency and/or magnitude that is/are below the predetermined threshold, and/or when the fluid measurements indicate that the property of the fluid being discharged out of the wellbore 102 is at steady state.

After the controller 302 determines that the influx of formation fluid into the wellbore 102 stops and/or the formation fluid (e.g., a gas pocket) is discharged from the wellbore 102, the controller 302 may stop well control operations and re-start MPD operations. For example, the controller 302 may cause the RCD 138 to close (if the RCD 138 is open), cause the BOP stack 130 to open (if the BOP stack is closed), cause the distribution manifold 310 to stop directing the fluid discharged out of the wellbore 102 to flow through the CK manifold 156 to stop performing well control operations, and cause the distribution manifold 310 to direct the fluid discharged out of the wellbore 102 to again flow through the MPD manifold 152 to thereby permit the MPD manifold 152 to again control the pressure of the fluid within the wellbore 102 to continue performing MPD operations.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the spirit and scope of the present disclosure.

The invention claimed is:

1. An apparatus comprising:

a control system for controlling pressure of fluid within a wellbore, wherein the control system comprises:

a rotating control device (RCD) fluidly connected with the wellbore;

a distribution manifold fluidly connected with the RCD;

a choke and kill (CK) manifold separate from the distribution manifold and fluidly connected with the distribution manifold;

a managed pressure drilling (MPD) manifold separate from the distribution manifold and fluidly connected with the distribution manifold, wherein the CK manifold and the MPD manifold are downstream of the distribution manifold;

a sensor operable to facilitate fluid measurements indicative of a property of the fluid, wherein the sensor is disposed in association with the distribution manifold; and a controller comprising a processor and a memory storing computer program code, wherein the controller is communicatively connected with the distribution manifold and the sensor, and wherein the controller is operable to:

receive the fluid measurements; and based on the fluid measurements:

cause the distribution manifold to direct the fluid discharged out of the wellbore via the RCD to flow through the MPD manifold to thereby permit the MPD manifold to control the pressure of the fluid within the wellbore; and cause the distribution manifold to direct the fluid discharged out of the wellbore via the RCD to flow through the CK manifold to thereby permit the CK manifold to control the pressure of the fluid within the wellbore.

2. The apparatus of claim 1, wherein the controller is further operable to detect an influx of formation fluid into the wellbore based on the fluid measurements, and wherein the controller is operable to, after detecting the influx of the formation fluid into the wellbore:

cause the distribution manifold to stop directing the fluid discharged out of the wellbore to flow through the MPD manifold; and cause the distribution manifold to direct the fluid discharged out of the wellbore to flow through the CK manifold to thereby permit the CK manifold to control the pressure of the fluid within the wellbore.

3. The apparatus of claim 1, wherein the sensor is or comprises a pressure sensor operable to facilitate pressure measurements indicative of the pressure of the fluid.

4. The apparatus of claim 1, wherein the sensor is or comprises a flow rate sensor operable to facilitate fluid flow rate measurements indicative of a flow rate of the fluid discharged out of the wellbore.

5. The apparatus of claim 1, wherein the distribution manifold comprises one or more fluid control valves selectively operable to direct the fluid discharged out of the wellbore to flow through a selectable one of the MPD manifold and the CK manifold.

6. The apparatus of claim 1, wherein the controller is operable to:

cause the distribution manifold to direct the fluid discharged out of the wellbore to flow through the MPD manifold when the fluid measurements indicate that the property of the fluid is below a predetermined threshold to thereby permit the MPD manifold to control the pressure of the fluid within the wellbore; and cause the distribution manifold to direct the fluid discharged out of the wellbore to flow through the CK manifold when the fluid measurements indicate that the property of the fluid is above the predetermined threshold to thereby permit the CK manifold to control the pressure of the fluid within the wellbore.

7. The apparatus of claim 1, wherein:

the fluid is a first fluid;

the sensor is or comprises a first flow rate sensor operable to facilitate first fluid flow rate measurements indicative of a first flow rate of the first fluid discharged out of the wellbore;

the control system further comprises a second flow rate sensor disposed in association with a fluid inlet for injecting a second fluid into the wellbore, wherein the second flow rate sensor is operable to facilitate second fluid flow rate measurements indicative of a second flow rate of the second fluid being injected into the wellbore; and the controller is operable to:

receive the second fluid flow rate measurements;

determine a flow rate difference between the first flow rate and the second flow rate; and cause the distribution manifold to direct the first fluid discharged out of the wellbore to flow through one of the MPD manifold and the CK manifold based on the flow rate difference.

8. The apparatus of claim 7, wherein the controller is operable to, when the first flow rate is greater than the second flow rate by a predetermined flow rate difference:

cause the distribution manifold to stop directing the first fluid discharged out of the wellbore to flow through the MPD manifold; and cause the distribution manifold to direct the first fluid discharged out of the wellbore to flow through the CK manifold to thereby permit the CK manifold to control the pressure of the first fluid within the wellbore.

9. The apparatus of claim 1, wherein the controller is further operable to:

when the fluid measurements indicate that the property of the fluid being discharged out of the wellbore is at steady state, cause the distribution manifold to direct the fluid discharged out of the wellbore to flow through the MPD manifold to thereby permit the MPD manifold to control the pressure of the fluid within the wellbore; and when the fluid measurements indicate that the property of the fluid being discharged out of the wellbore is not at steady state, cause the distribution manifold to direct the fluid discharged out of the wellbore to flow through the CK manifold to thereby permit the CK manifold to control the pressure of the fluid within the wellbore.

10. The apparatus of claim 1, wherein:

the controller is also communicatively connected with the MPD manifold and the CK manifold; and the controller is further operable to:

control a choke of the MPD manifold to thereby control the pressure of the fluid within the wellbore when the distribution manifold directs the fluid discharged out of the wellbore to flow through the MPD manifold; and control a choke of the CK manifold to thereby control the pressure of the fluid within the wellbore when the distribution manifold directs the fluid discharged out of the wellbore to flow through the CK manifold.

11. The apparatus of claim 10, wherein the controller is operable to control a flow restriction position of the choke of the MPD manifold to control flow rate and/or pressure of the fluid discharged from the wellbore to thereby control the pressure of the fluid within the wellbore, and wherein the controller is operable to control a flow restriction position of the choke of the CK manifold to control flow rate and/or pressure of the fluid discharged from the wellbore to thereby control the pressure of the fluid within the wellbore.

12. An apparatus comprising:

a control system for controlling pressure of fluid within a wellbore, wherein the control system comprises:

a rotating control device (RCD) fluidly connected with the wellbore;

a distribution manifold fluidly connected with the RCD;

a choke and kill (CK) manifold separate from the distribution manifold and fluidly connected with the distribution manifold;

a managed pressure drilling (MPD) manifold separate from the distribution manifold and fluidly connected with the distribution manifold, wherein the CK manifold and the MPD manifold are downstream of the distribution manifold;

a sensor operable to facilitate position measurements of a flow restriction position of a choke of the MPD manifold, and the flow restriction position is variable to vary flow of the fluid through the MPD manifold; and a controller comprising a processor and a memory storing computer program code, wherein the controller is communicatively connected with the distribution manifold and the sensor, and wherein the controller is operable to:

receive the position measurements; and based on the position measurements, switching between:

causing the distribution manifold to direct the fluid discharged out of the wellbore via the RCD to flow through the MPD manifold to thereby permit the MPD manifold to control the pressure of the fluid within the wellbore; and causing the distribution manifold to direct the fluid discharged out of the wellbore via the RCD to flow through the CK manifold to thereby permit the CK manifold to control the pressure of the fluid within the wellbore.

13. The apparatus of claim 12, wherein:

when the controller is causing the distribution manifold to direct the fluid discharged out of the wellbore via the RCD to flow through the MPD manifold to thereby permit the MPD manifold to control the pressure of the fluid within the wellbore, the CK manifold cannot control the wellbore fluid pressure; and when the controller is causing the distribution manifold to direct the fluid discharged out of the wellbore via the RCD to flow through the CK manifold to thereby permit the CK manifold to control the pressure of the fluid within the wellbore, the MPD manifold cannot control the wellbore fluid pressure.

14. The apparatus of claim 12, wherein the controller is further operable to detect an influx of formation fluid into the wellbore based on the position measurements, and wherein the controller is operable to, after detecting the influx of the formation fluid into the wellbore:

cause the distribution manifold to stop directing the fluid discharged out of the wellbore to flow through the MPD manifold; and cause the distribution manifold to direct the fluid discharged out of the wellbore to flow through the CK manifold to thereby permit the CK manifold to control the pressure of the fluid within the wellbore.

15. The apparatus of claim 12, wherein the controller is operable to, in response to the position measurements being indicative of the flow restriction position of the choke changing at a frequency and/or magnitude that is/are above a predetermined threshold:

cause the distribution manifold to stop directing the fluid discharged out of the wellbore to flow through the MPD manifold; and cause the distribution manifold to direct the fluid discharged out of the wellbore to flow through the CK manifold to thereby permit the CK manifold to control the pressure of the fluid within the wellbore.

16. An apparatus comprising:

a control system for controlling pressure of fluid within a wellbore, wherein the control system comprises:

a rotating control device (RCD) fluidly connected with the wellbore;

a distribution manifold fluidly connected with the RCD;

a choke and kill (CK) manifold separate from the distribution manifold and fluidly connected with the distribution manifold;

a managed pressure drilling (MPD) manifold separate from the distribution manifold and fluidly connected with the distribution manifold, wherein the CK manifold and the MPD manifold are downstream of the distribution manifold;

a sensor operable to facilitate sensor measurements; and a controller comprising a processor and a memory storing computer program code, wherein the controller is communicatively connected with the distribution manifold, the MPD manifold, and the sensor, and wherein the controller is operable to:

cause the distribution manifold to direct the fluid discharged out of the wellbore via the RCD to flow through the MPD manifold;

cause the MPD manifold to control the pressure of the fluid within the wellbore during MPD operations;

detect an excess influx of formation fluid into the wellbore based on the sensor measurements; and in response to the excess influx detection, cause the distribution manifold to stop directing the fluid discharged out of the wellbore to flow through the MPD manifold, and then cause the distribution manifold to direct the fluid discharged out of the wellbore via the RCD to flow through the CK manifold to thereby permit the CK manifold to control the pressure of the fluid within the wellbore to perform well control operations.

17. The apparatus of claim 16, wherein the sensor is or comprises a fluid sensor, and wherein the sensor measurements are or comprise fluid measurements indicative of a property of the fluid.

18. The apparatus of claim 16, comprising a first fluid path from the distribution manifold to the CK manifold, and a second fluid path from the distribution manifold to the MPD manifold.

19. The apparatus of claim 18, comprising a third fluid path from the distribution manifold to a drilling fluid cleaning and reconditioning equipment.

20. The apparatus of claim 16, wherein the sensor is or comprises a position sensor, and wherein the sensor measurements are or comprise position measurements of a flow restriction position of a choke of the MPD manifold, and the flow restriction position is variable to vary flow of the fluid through the MPD manifold.

* * * * *